US008074567B2

(12) United States Patent
Atiyeh et al.

(10) Patent No.: US 8,074,567 B2
(45) Date of Patent: Dec. 13, 2011

(54) CONTAINER COMPRESSION DEVICE AND A METHOD FOR IMPLEMENTING SAME

(76) Inventors: Phil Atiyeh, Cheshire, CT (US); Ty Hagler, Durham, NC (US)

( * ) Notice: Subject to any disclaimer, the term of this patent is extended or adjusted under 35 U.S.C. 154(b) by 206 days.

(21) Appl. No.: 12/317,357

(22) Filed: Dec. 22, 2008

(65) Prior Publication Data

US 2010/0155361 A1 Jun. 24, 2010

(51) Int. Cl.
*B30B 1/04* (2006.01)

(52) U.S. Cl. ..... 100/283; 100/219; 100/264; 100/902; 222/103

(58) Field of Classification Search ..... 100/219, 100/232, 233, 234, 236, 264, 281, 283, 902, 100/DIG. 2; 241/99
See application file for complete search history.

(56) References Cited

U.S. PATENT DOCUMENTS 3,901,141 A * 8/1975 Bochmann ..... 100/236
4,456,134 A 6/1984 Cooper
4,475,449 A * 10/1984 Gianelo ..... 100/42
4,747,496 A 5/1988 Rendine
4,790,361 A 12/1988 Jones
4,953,750 A 9/1990 Abernathy
4,989,743 A 2/1991 Lowery
5,025,953 A 6/1991 Doundoulakis
5,233,917 A * 8/1993 Handzlik ..... 100/232

* cited by examiner

*Primary Examiner* — Jimmy T Nguyen
(74) *Attorney, Agent, or Firm* — Steven M. McHugh

(57) ABSTRACT

A container compression device and a method for associating a beverage container with the container compression device is provided, wherein the container compression device is configurable between an extended configuration and a compressed configuration, container compression device including a first handle portion, wherein the first handle portion includes a plurality of first handle portion linking members pivotably associated with the first handle portion. The container compression device also includes a second handle portion, wherein the second handle portion includes a plurality of second handle portion linking members pivotably associated with the second handle portion. Additionally, the plurality of second handle portion linking members are rotatably connected to the plurality of first handle portion linking members via at least one releasable locking device, wherein the at least one releasable locking device is configurable between an engaged configuration and a disengaged configuration.

20 Claims, 21 Drawing Sheets

Section A-A

CONTAINER COMPRESSION DEVICE AND A METHOD FOR IMPLEMENTING SAME

FIELD OF THE INVENTION

This disclosure relates generally to an apparatus for deforming a plastic bottle and more particularly to an easily operable apparatus for controlling the effervescence of a carbonated liquid sealed within a deformable container to preserve the carbonation of the beverage.

BACKGROUND OF THE INVENTION

Carbonated beverages and the like are well known and have been in existence in one form or another for over several hundred years. For example, beer is the oldest, most widely consumed carbonated alcoholic beverage and dates back to over one thousand years. Carbonation occurs when carbon dioxide is dissolved in a liquid, such as water or some other aqueous solution (i.e. soda) and can occur as a result of both forced and natural processes. For instance, carbon dioxide can be forcefully and artificially dissolved under pressure into a liquid or carbon dioxide can dissolve into a liquid due to naturally occurring processes, such as through fermentation. In either case, dissolving carbon dioxide into a beverage can have a beneficial effect on the presentation and flavor of the beverage. In many consumer beverages such as soda, carbonation is used to give a 'crisp' presentation and a flavor 'bite' to the drink by interacting with dilute carbonic or phosphoric acids. And as such, many modern soft drinks, such as soda, wine coolers, sparking waters, etc., contain some measure of carbonation.

However, as is known if a carbonated liquid is not maintained within a controlled sealed environment the carbon dioxide within the liquid will escape via a process referred to as effervescence. This effervescence typically manifests itself as foam or fizz that is caused from the release of gas from the liquid and eventually results in a beverage which has an un-carbonated or 'flat' presentation. This is undesirable because this 'flat' presentation typically results in a detrimentally modified flavor profile as experienced by the consumer. This problem is addressed incidentally because the FDA requires that manufacturers of carbonated beverages store, ship and sell the carbonated beverages in containers that are sealed to be air tight. Accordingly, the carbonated beverages will maintain their freshness or effervescence until the container is opened and the seal is broken. Referring to FIG. 1A, one such beverage container 100, in this case a plastic bottle, is illustrated and shows a carbonated beverage 102 contained within the container 100 such that the beverage 102 is at a predetermined level $L_1$. This allows for a small space 106 to separate the beverage 102 from the top of the container 100. During packaging once the beverage has been dispensed into the container 100, the container 100 is sealed using a sealing device 108, in this case a threaded bottle cap. Referring to FIG. 1B, as the carbonated beverage 102 sits within the sealed container 100, carbon dioxide 110 is released into the small space 106 via effervescence and fills up the volume $V_1$ of the space 106 until the pressure within the container 100 reaches a level where effervescence from the beverage 102 can no longer occur. Typically, the volume $V_1$ of the space 106 between the top of the beverage 102 and the top of the container 100 is sized such that only a small amount of carbon dioxide can be released from the beverage before the pressure within the container 100 reaches an equilibrium with the carbon dioxide in the beverage and effervescence can no longer occur. At this point, the carbonated beverage will maintain its effervescence without the beverage going 'flat'.

Unfortunately however, once a consumer opens the container 100 the pressure within the container 100 is released and effervescence once again begins to occur. Referring to FIG. 1C, each time the consumer removes some of the beverage 102 from the container 100 and reseals the container 100, the space 106 between the top of the new level $L_2$ of the beverage 102 and the top of the container 100 is filled up with carbon dioxide 110 via effervescence from the beverage 102. This creates a condition where the space 106 between the top of the beverage 102 and the top of the container 100 continually increases in volume. And as this new volume $V_2$ increases in size, so too does the amount of carbon dioxide released from the beverage 102, in order to achieve a pressure equilibrium within the container 100. Thus, the amount of carbon dioxide 110 within the beverage 102 eventually becomes depleted resulting in a 'flat' beverage. This is undesirable because most consumers don't enjoy a 'flat' beverage which results in any remaining beverage 102 being disposed of as waste.

One way to prevent carbonated beverages from becoming 'flat' is by keeping the volume $V_2$ of the space 106 between the top of the beverage 102 and the top of the container 100 to a minimum (for example, $V_2=V_1$) so that the above discussed equilibrium with the container 100 can be achieved with a minimal amount of effervescence. Up until about 35 years ago, this was impractical because carbonated beverage containers 102 were constructed of glass or metal. However, with the advent of deformable plastic beverage containers, several devices have been introduced to help solve this problem. Unfortunately, these devices are complicated, cumbersome, difficult to use and don't achieve the desired result.

SUMMARY OF THE INVENTION

A container compression device configurable between an extended configuration and a compressed configuration, container compression device including a first handle portion, wherein the first handle portion includes a plurality of first handle portion linking members pivotably associated with the first handle portion. The container compression device also includes a second handle portion, wherein the second handle portion includes a plurality of second handle portion linking members pivotably associated with the second handle portion. Additionally, the plurality of second handle portion linking members are rotatably connected to the plurality of first handle portion linking members via at least one releasable locking device, wherein the at least one releasable locking device is configurable between an engaged configuration and a disengaged configuration.

A container compression device defining a container compression device cavity for holding a beverage container is provided, wherein the container compression device is configurable between an extended configuration and a compressed configuration. The container compression device includes a plurality of handle portions pivotably associated with each other via at least one releasable locking device configurable between an engaged configuration and a disengaged configuration to lockingly configure the container compression device between the extended configuration and the compressed configuration, wherein when the container compression device is configured in the extended configuration the container compression device cavity is larger than when the container compression device is configured in the compressed configuration.

A method for associating a beverage container containing a beverage with a container compression device defining a container compression device cavity is provided, wherein the container compression device is configurable between an extended configuration and a compressed configuration. The method includes configuring the container compression device into the extended configuration and positioning the beverage container within the container compression device cavity. The method further includes configuring the container compression device into the compressed configuration to compress the beverage container. If beverage is removed from the beverage container, then configuring the container compression device into the compressed configuration is repeated. The method further includes configuring the container compression device into the extended configuration and removing the beverage container from the container compression device cavity.

BRIEF DESCRIPTION OF DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

Figure 1A:
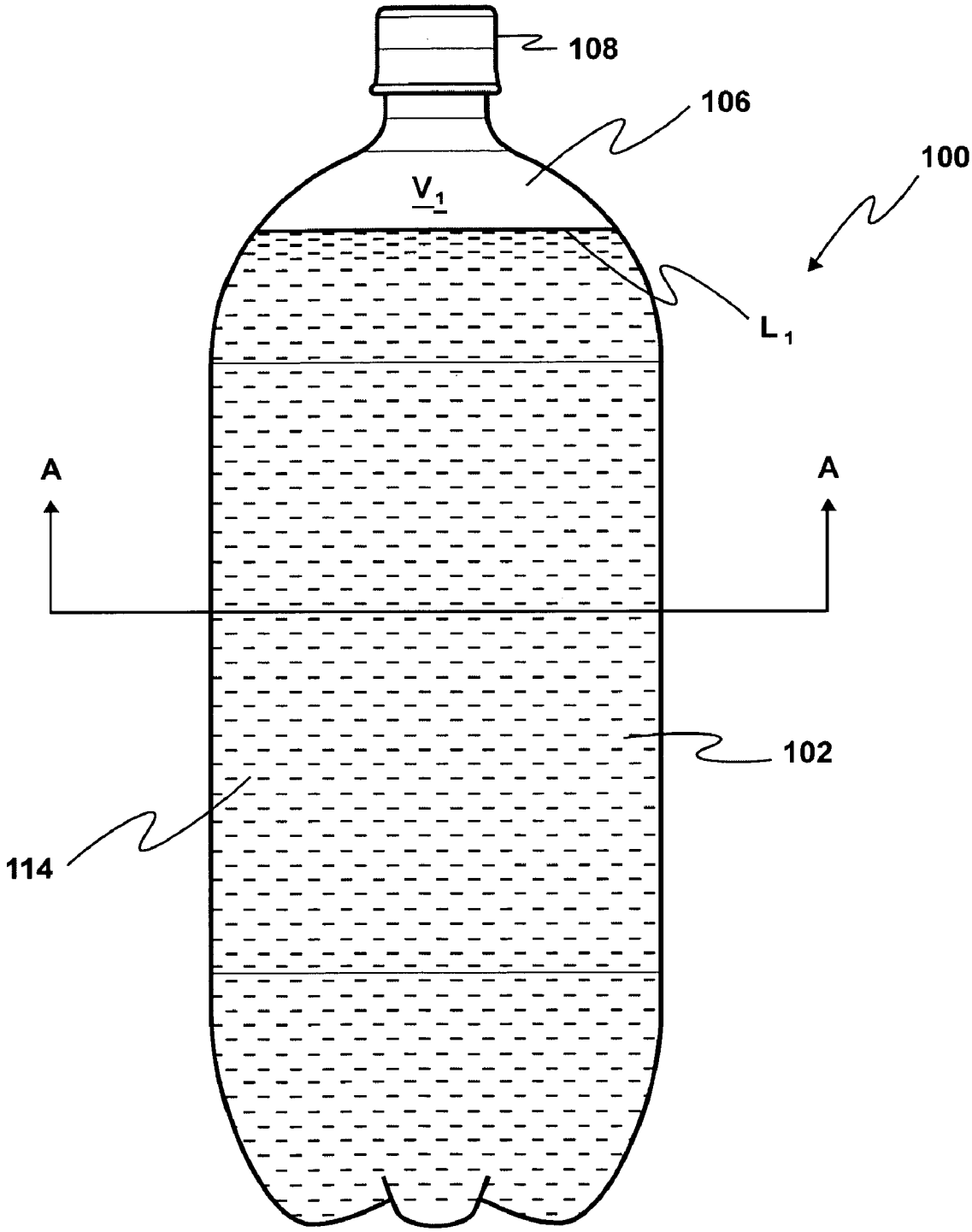
FIG. 1A is a side view of a plastic beverage container filled with a carbonated beverage.
Figure 1B:
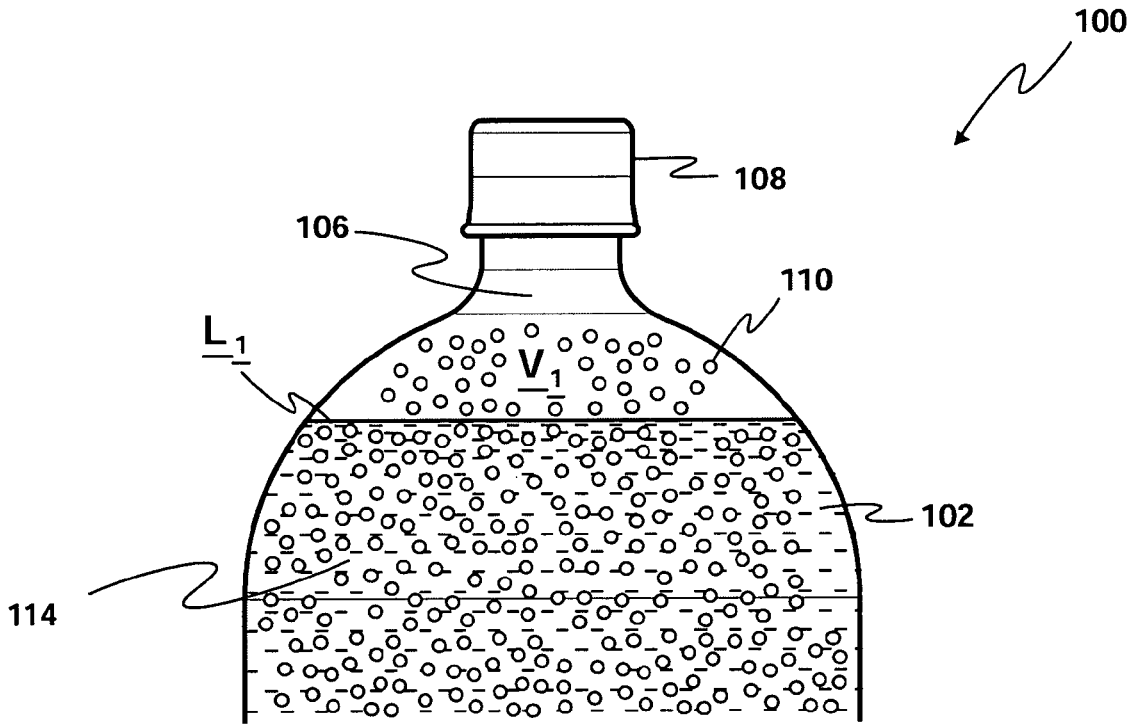
FIG. 1B is a sectional side view of the plastic beverage container of FIG. 1A filled with a carbonated beverage.
Figure 1C:
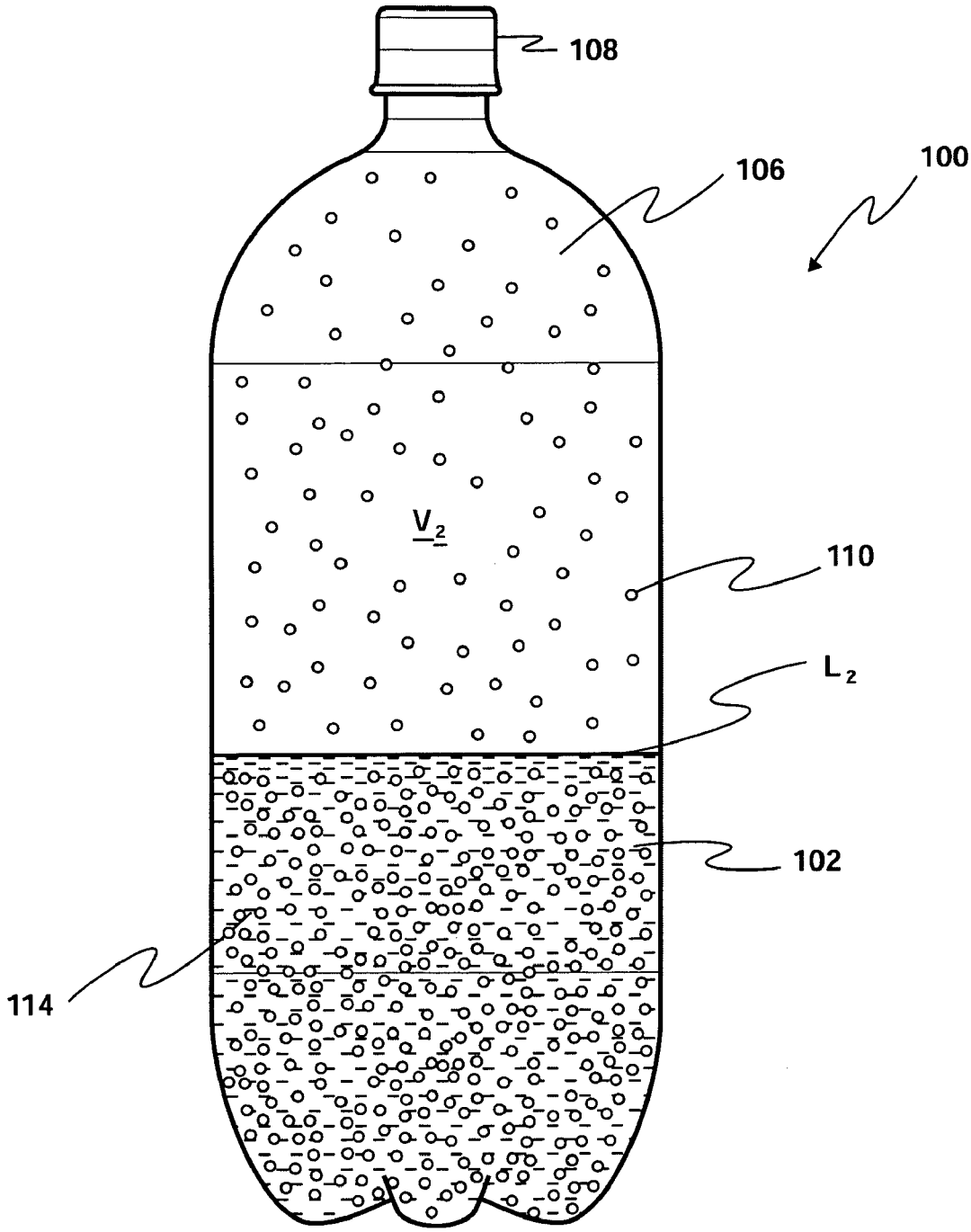
FIG. 1C is a side view of the plastic beverage container of FIG. 1A partially filled with a carbonated beverage.
Figure 2:
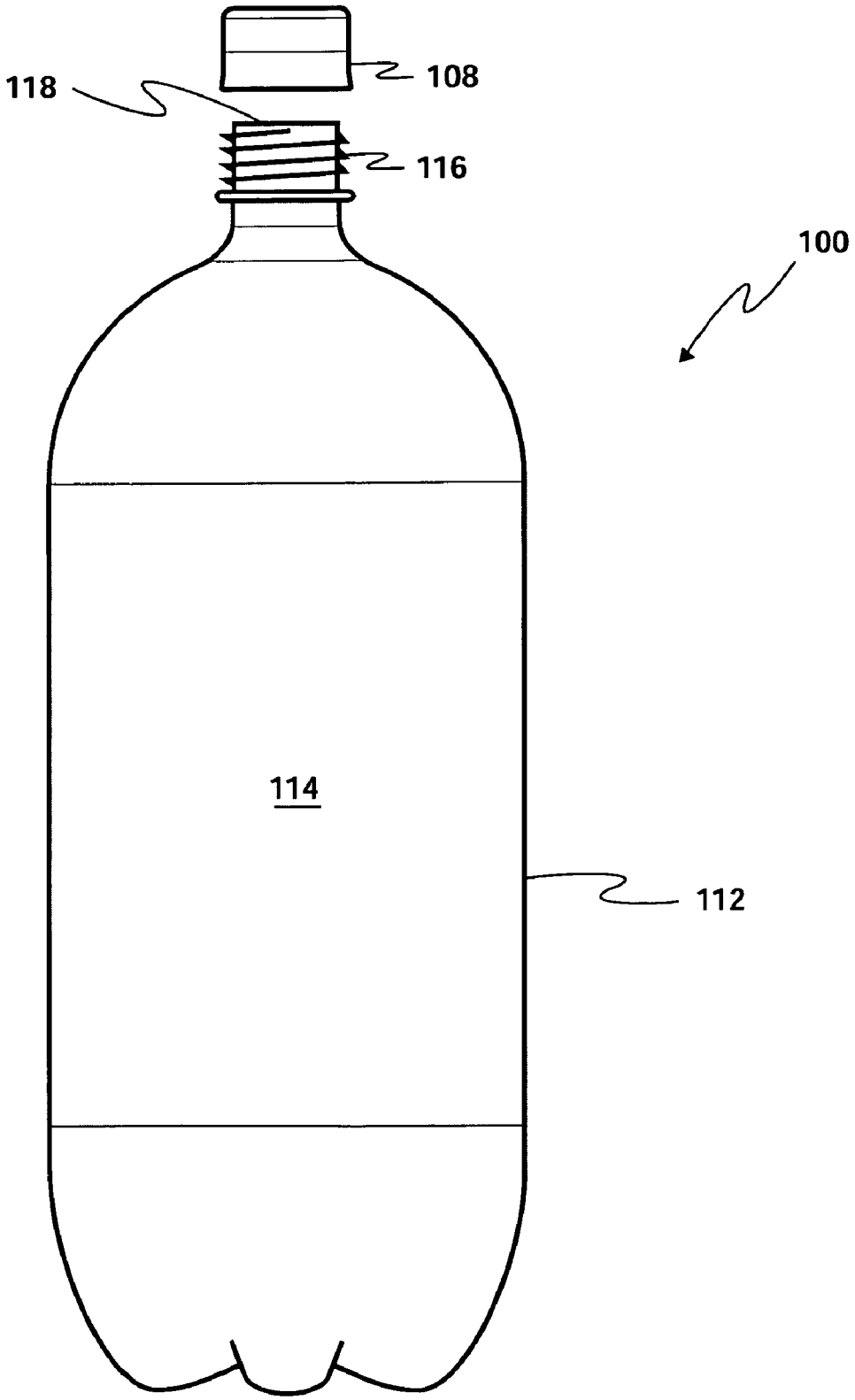
FIG. 2 is a side view of the beverage container of FIG. 1.

Referring to FIG. 2, the deformable beverage container 100 as shown in FIG. 1A is illustrated absence the carbonated beverage 102. The beverage container 100 includes a container structure 112 which defines a cavity 114 for containing the carbonated beverage 102. The container structure 112 includes a threaded portion 116 which defines an opening 118 for accessing the cavity 114, wherein the threaded portion 116 is configured to sealingly and securingly allow the threaded portion 116 and cap 108 to interact with each other such that the cavity 114 is substantially sealed air tight. As is commonly known, all or some of the beverage 102 may be removed from the container 100 by removing (i.e. unscrewing) the cap 108 from the threaded portion 116 and tilting the container 100 such that the beverage 102 flows from the cavity 114 and out of the opening 118. The container 100 may then be resealed by securingly re-associating the cap 108 with the threaded portion 116 (i.e. screwing the cap 108 backing onto the container 100). It should be appreciated that although the invention is being discussed herein with regards to a container 100 having a threaded portion 116 and a removable cap 108 for sealing and resealing the container 100, this is purely for example and the invention can be used with a container 100 having any type of sealing/resealing device and/or method. Referring again to FIG. 1A and FIG. 1B, it should be appreciated that when the carbonated beverage 102 is initially sealed inside of the container cavity 114, the level $L_1$ of the beverage 102 is such that the space 106 between the top of the container cavity 114 and the beverage 102 has a volume $V_1$ which is typically sized such that only a small amount of carbon dioxide can be released from the beverage 102 before the pressure in the container 100 reaches an equilibrium with the carbon dioxide in the beverage 102 and effervescence can no longer occur. However, referring again to FIG. 1C, each time a portion of the beverage 102 is removed from the container cavity 114, the level $L_2$ of the beverage 106 decreases and the space 106, and thus volume $V_2$ of the space 106, between the top of the container cavity 114 and the beverage 102 increases.

Referring to FIG. 3, FIG. 4, FIG. 5 and FIG. 6, a container compression device 200 is illustrated in accordance with one embodiment of the present invention. The container compression device 200 includes a first handle portion 202 and a second handle portion 204. First handle portion 202 includes a gripping member 205 and two first handle portion linking members 206 each positioned on opposing sides of the first handle portion 202. Each of the first handle portion linking members 206 are pivotably connected to the first handle portion 202 such that one of the first handle portion linking members 206 pivots about a first handle first axis $A_1$ and the other of the first handle portion linking members 206 pivots about a first handle second axis $A_2$. Similarly, second handle portion 204 includes a gripping member 207 and two second handle portion linking members 208 each positioned on opposing sides of the second handle portion 204. Each of the second handle portion linking members 208 are also pivotably connected to the second handle portion 204 such that one of the second handle portion linking members 208 pivots about a second handle first axis $A_3$ and the other of the second handle portion linking members 208 pivots about a second handle second axis $A_4$. It should be appreciated that axes $A_1$, $A_2$, $A_3$ and $A_4$ are substantially parallel with each other.

Furthermore, container compression device 200 includes two handle junctions 210 which are formed by connecting the first handle portion linking members 206 with the second handle portion linking members 208. As shown in the figures, one of the first handle portion linking members 206 is connected to one of the second handle portion linking members 208 and the other of the first handle portion linking members 206 is connected to the other of the second handle portion linking members 208 to form a container compression device cavity 212 between the first handle portion 202 and the second handle portion 204. The two handle junctions 210 are configured to allow the first handle portion linking members 206 and the second handle portion linking members 208 to pivot relative to each about a junction axes $J_1$ and $J_2$. Moreover, at least one of the two handle junctions 210 includes a releasable locking device 214 which is easily releasable via a finger of the user. For example, one embodiment includes one of the two handle junctions 210 having a releasable locking device 214 while another embodiment includes both of the two handle junctions 210 having a releasable locking device 214. Still yet other embodiments include a releasable locking device 214 being located in other locations of the container compression device 200, such as at the connection point(s) between at least one of the first handle portion linking members 206 (and/or the second handle portion linking members 208) and the first handle portion 202 (and/or the second handle portion 204). One embodiment of the releasable locking device 214 is illustrated in FIG. 7, FIG. 8, FIG. 9 and FIG. 10 and is discussed in greater detail hereinafter. This allows the container compression device 200 to configure the container compression device cavity 212 between an extended configuration 220 and a compressed configuration 222.

Figure 3:
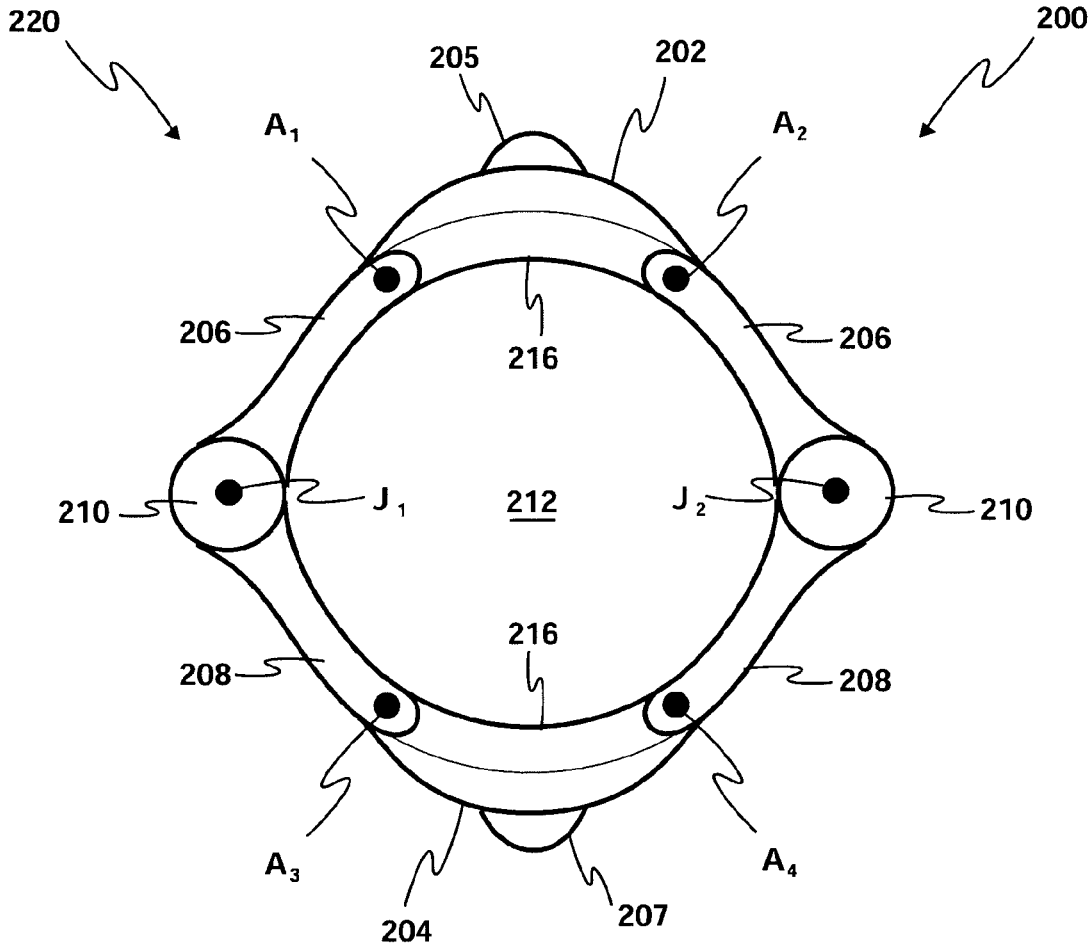
FIG. 3 is a top down view of a container compression device for controlling the effervescence of a carbonated beverage within a beverage container in an extended configuration, in accordance with an embodiment of the invention.
Figure 4:
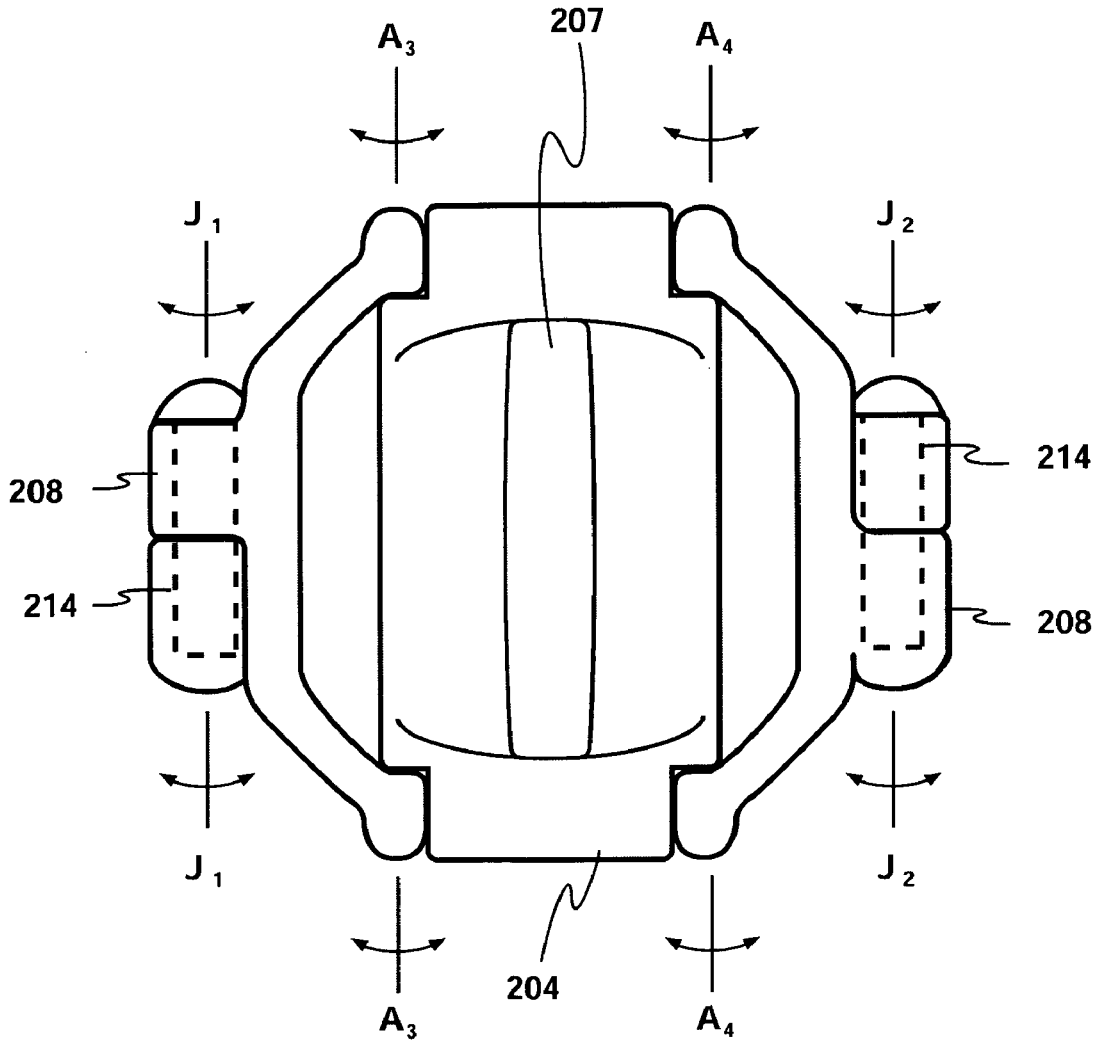
FIG. 4 is a side view of the container compression device of FIG. 3.
Figure 5:
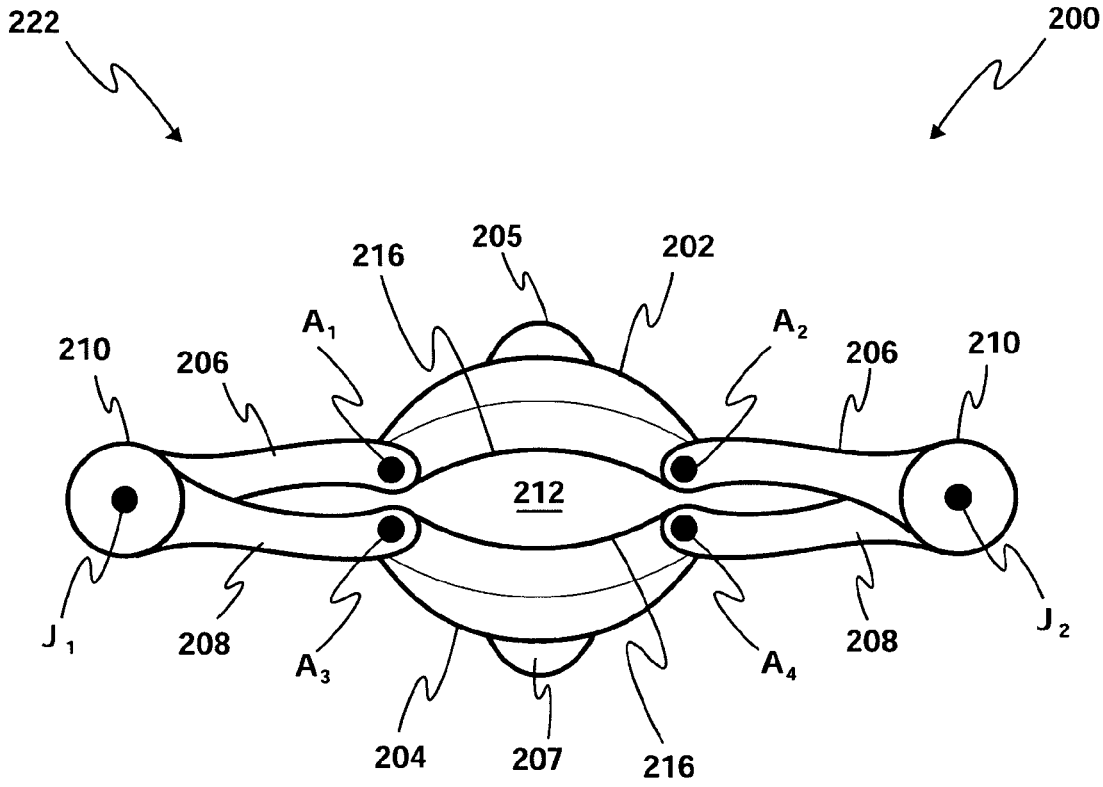
FIG. 5 is a top down view of the container compression device of FIG. 3 in a compressed configuration.
Figure 6:
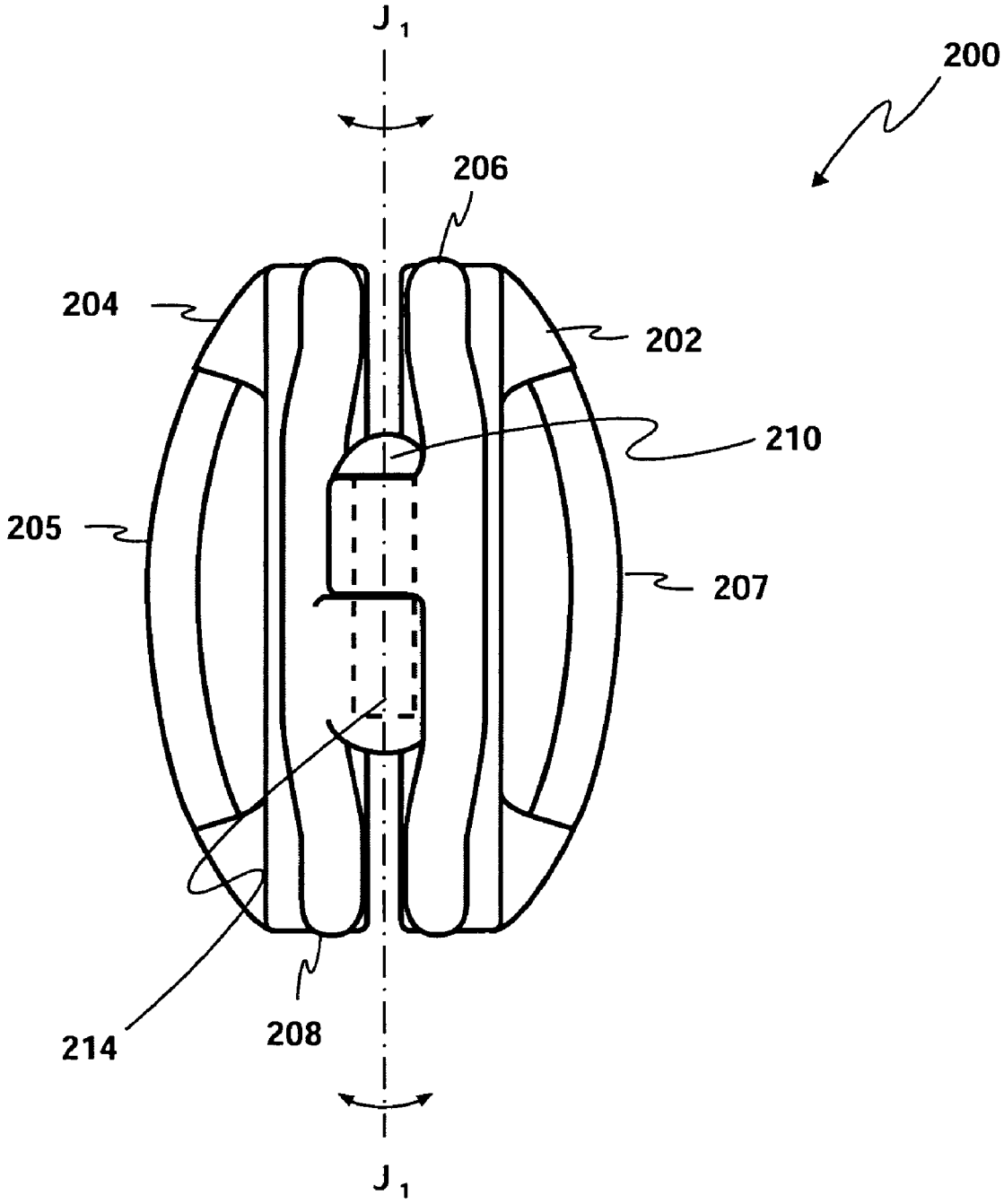
FIG. 6 is a side view of the container compression device of FIG. 3 in a compressed configuration.
Figure 7:
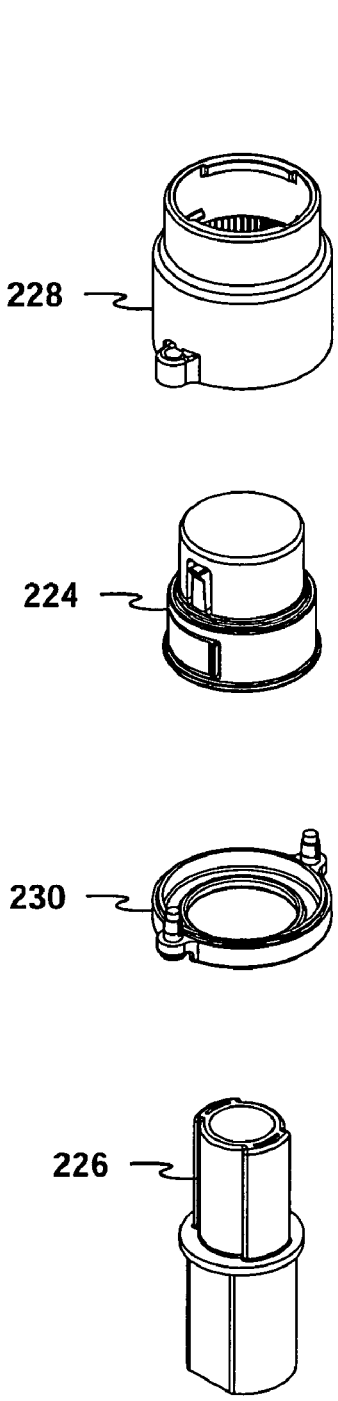
FIG. 7 is an exploded side view of one embodiment of a releasable locking device, in accordance with the present invention.
Figure 8:
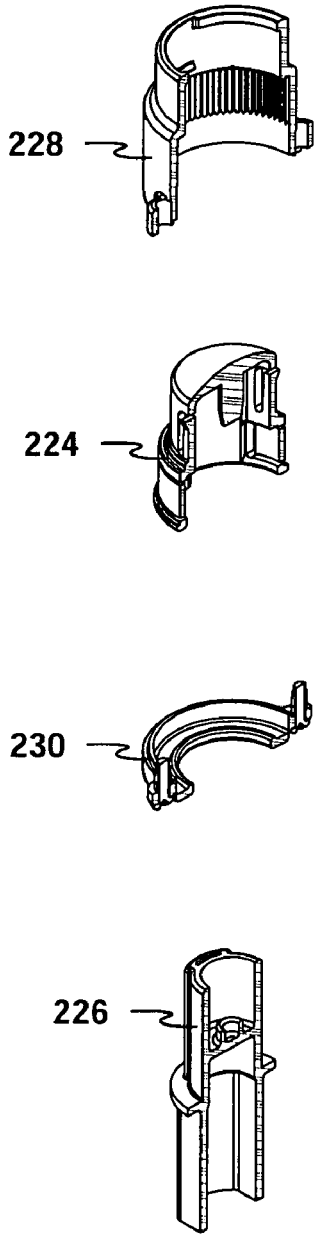
FIG. 8 is an exploded side sectional view of the releasable locking device of FIG. 7.

In accordance with one embodiment, at least one of the first handle portion 202 and the second handle portion 204 include a compression surface 216 which may be substantially curved in shape to be similar to the form of the side of the deformable beverage container 100. This allows the deformable beverage container 100 to 'seat' better within the container compression device cavity 212. However, it is contemplated that only one of the first handle portion 202 and the second handle portion 204 may include a compression surface 216 and the compression surface 216 may be any shape suitable to the desired end purpose. For example, the compression surface 216 may be slightly curved, substantially flat or may be ring shaped with a hollow portion where only the outside perimeter is in contact with the container 100. Additionally, the compression surface 216 may include rounded edges to prevent puncture of the container 102. When the container compression device 200 is in the extended configuration 220 container compression device cavity 212 is sized to receive the beverage container 100. As briefly mentioned hereinabove, it should be appreciated that container compression device 200 is configurable between the extended configuration 220 (as shown in FIG. 3 and FIG. 4) and the compressed configuration 222 (as shown in FIG. 5 and FIG. 6) such that the container compression device cavity 212 is configurable to interact with any suitable container having a size equal to or smaller than the container compression device cavity 212 when the container compression device 200 is configured in the extended configuration 220.

Figure 9A:
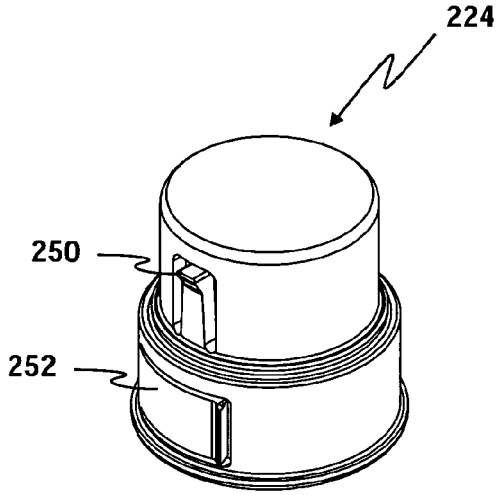
FIG. 9A is side view of an actuation button of the locking device of FIG. 7.
Figure 9B:
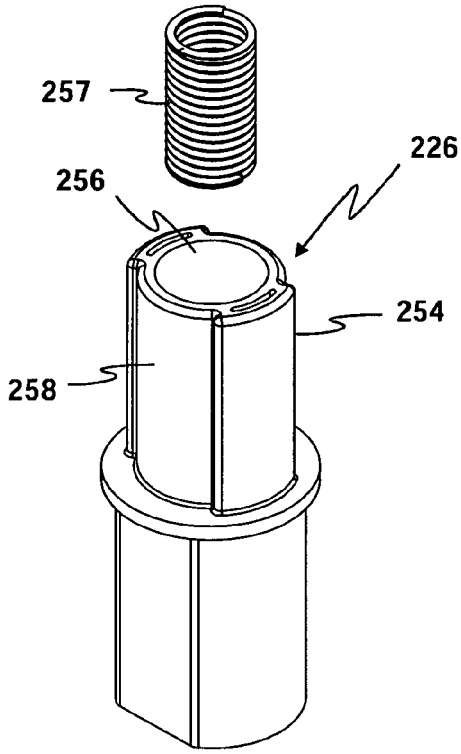
FIG. 9B is a side view the drive guide and guide spring of locking device of FIG. 7.
Figure 9C:
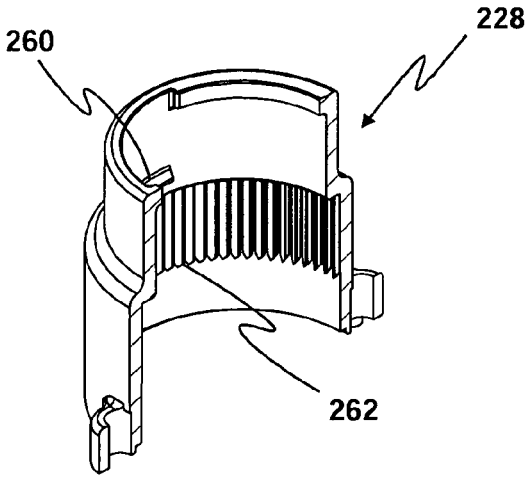
FIG. 9C is a side sectional view of the locking structure of the locking device of FIG. 7.
Figure 9D:
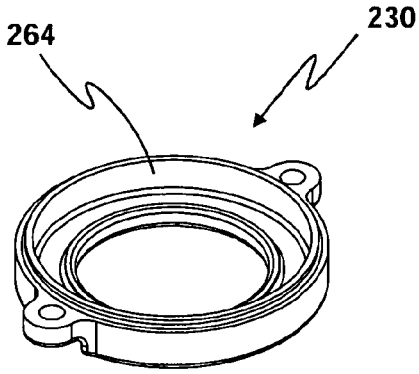
FIG. 9D is a side perspective view the end cap for the locking device of FIG. 7.
Figure 9E:
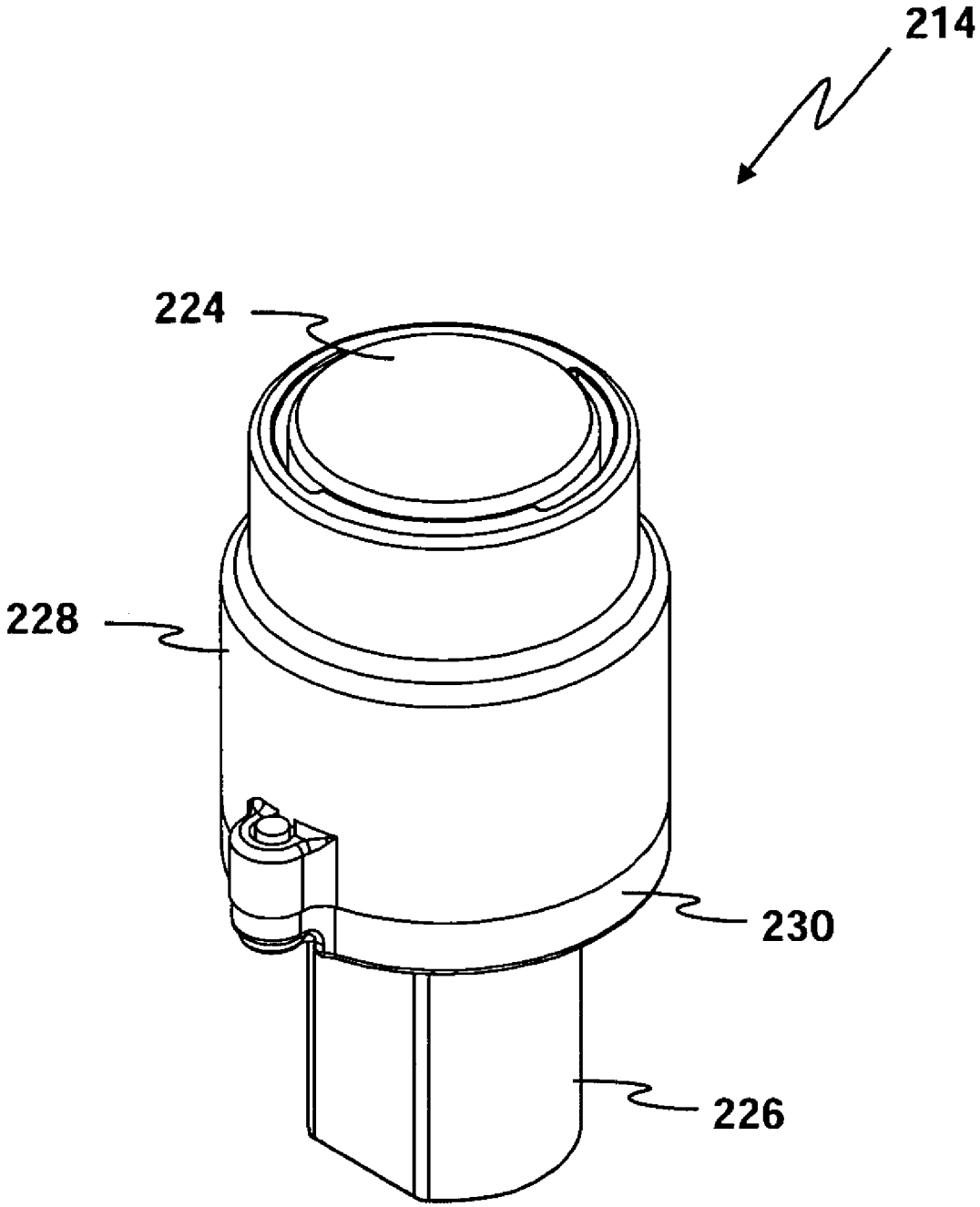
FIG. 9E is a side perspective view of the releasable locking device of FIG. 7.
Figure 10A:
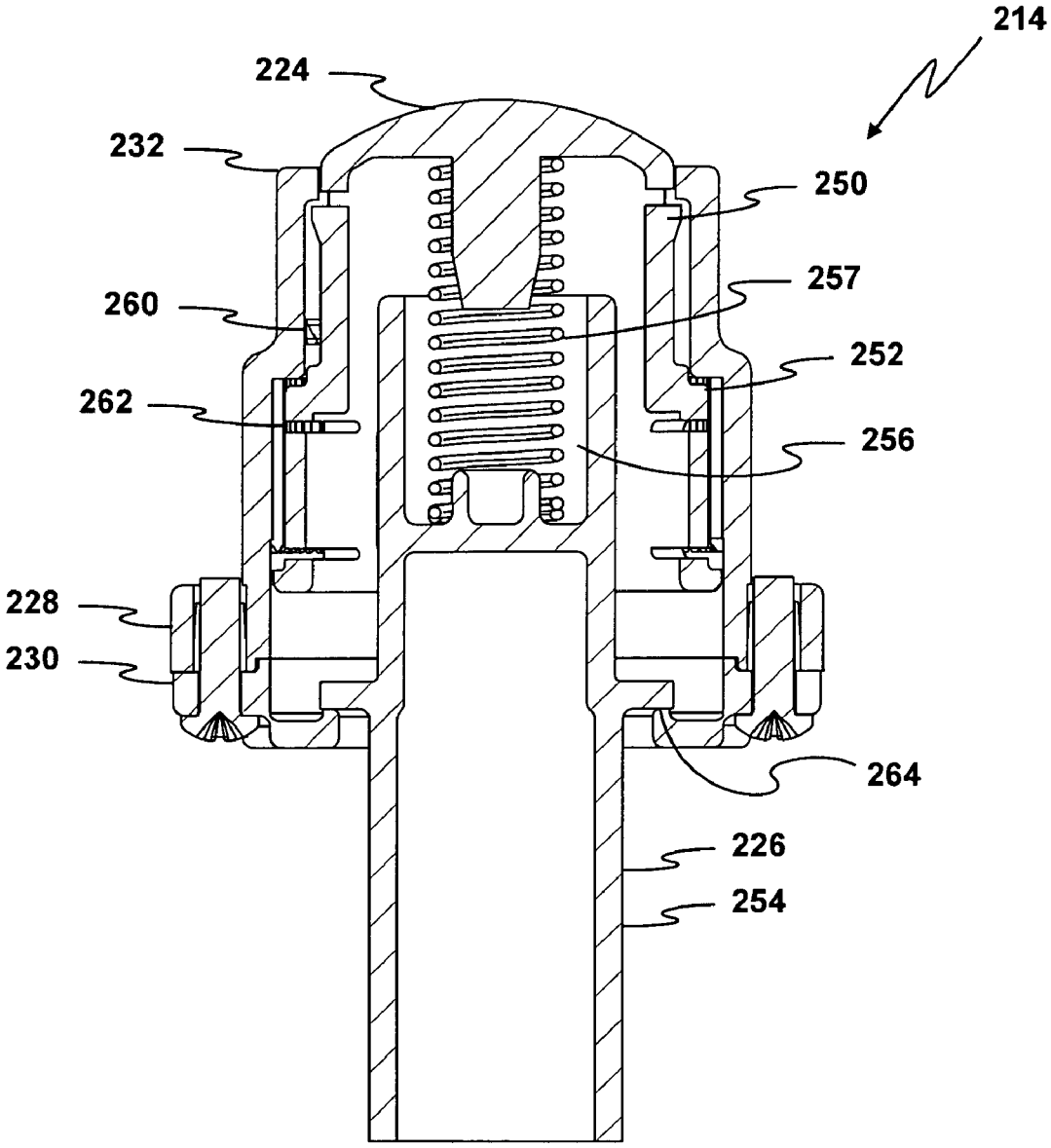
FIG. 10A is a side sectional view of the releasable locking device of FIG. 7 in the engaged configuration.
Figure 10B:
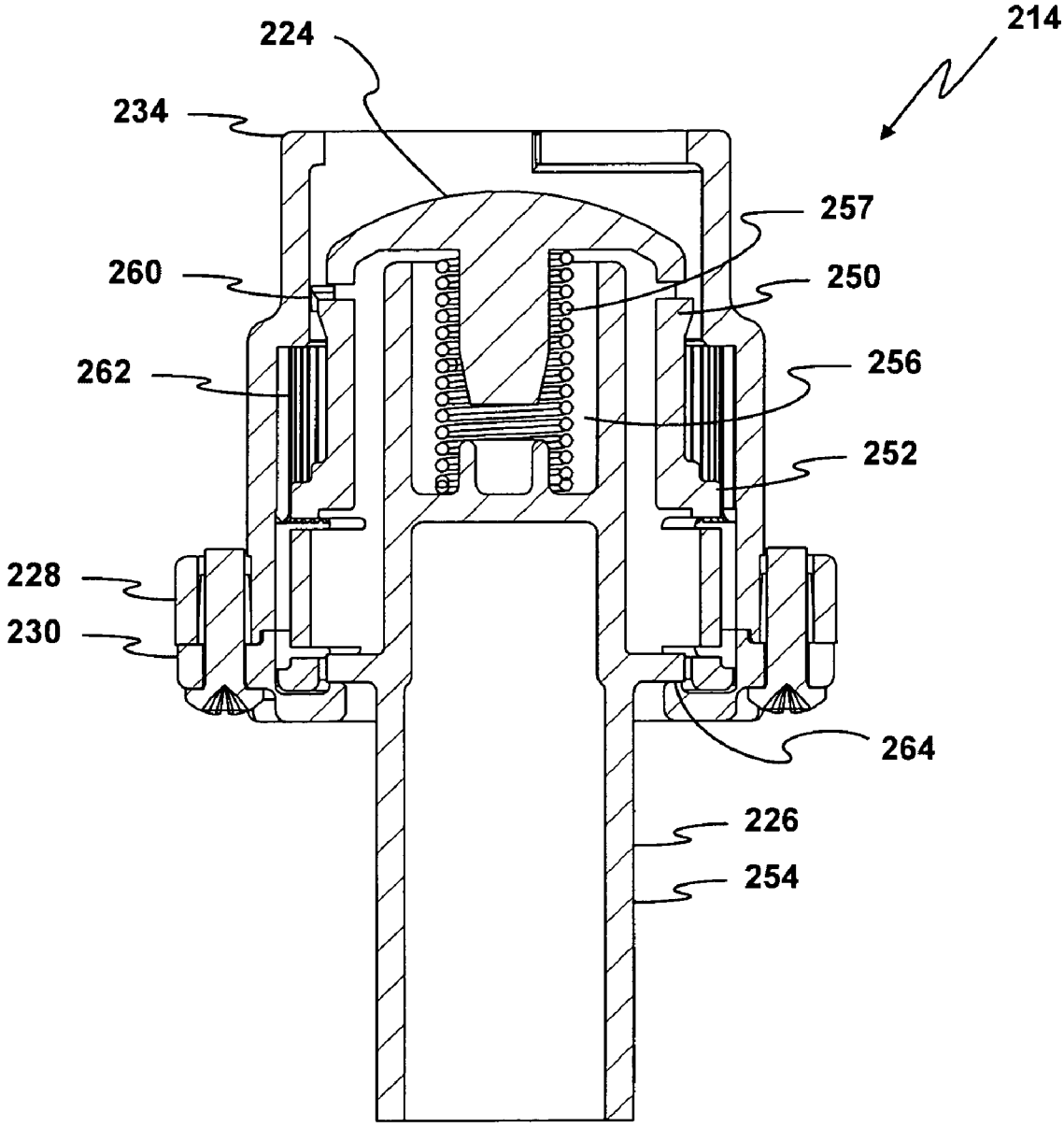
FIG. 10B is a side sectional view of the releasable locking device of FIG. 7 in the disengaged configuration.

Referring again to FIG. 7, FIG. 8, FIG. 9, FIG. 10A and FIG. 10B, one embodiment of the releasable locking device 214 is illustrated and includes an actuation button 224, a drive guide 226, a locking structure 228 and an end cap 230. The releasable locking device 214 is configurable between an engaged configuration 232 and a disengaged configuration 234, as shown in FIG. 10A and FIG. 10B. Referring to FIG. 9A, the actuation button 224 includes at least one compressible axial flex member 250 and at least one compressible radial flex member (pawl) 252. Referring to FIG. 9B, the drive guide 226 includes a structure 254 which defines a guide cavity 256 for containing a guide spring 257 and has at least one axial recessed portion 258 for interacting with the at least one axial flex member 250. Referring to FIG. 9C, the locking structure 228 includes a semi-annular protrusion 260 and a plurality of structure teeth 262. As explained in more detail hereinafter, the semi-annular protrusion 260 interacts with the at least one axial flex member 250 and the plurality of structure teeth 262 interact with the at least one radial flex member 252. Furthermore, referring to FIG. 9D, the end cap 230 includes a cap recessed portion 264 for receiving and seating the locking structure 228. When assembled, guide spring 257 is disposed within the guide cavity 256 and the actuation button 224 is positioned over the drive guide 226 to cover a portion of the drive guide 226. This combination is then positioned within the locking structure 228 and the locking structure 228 is associated with the end cap 230 such that the drive guide 226 is positioned within the cap recessed portion 264 and seated with the end cap 230. It is contemplated that the locking structure 228 and the end cap 230 may be held together using any device and/or method suitable to the desired end purpose, such as clips, screws, snaps and adhesives. The assembled releasable locking device 214 is illustrated in FIG. 9E. It should be appreciated that the drive guide 226 is attached to at least one each of the first handle portion linking members 206 and the locking structure 228 is attached to at least one of the second handle portion linking members 208 such that when the first handle portion linking members 206 and the second handle portion linking members 208 rotate relative to each other, the drive guide 226 also rotates with respect to the locking structure 228.

Referring to FIG. 10A the releasable locking device 214 configured in the engaged configuration 232 is illustrated. While in the engaged configuration 232, the actuation button 224 is held in an upward position via the guide spring 257 which is pushing upward (away from the end cap 230) on the actuation button 224. The structure teeth 262 and the at least one radial flex member 252 are disposed to be adjacent each other to engagingly interact. As the container compression device 200 is configured between the extended configuration 220 and the compressed configuration 222, the first handle portion linking members 206 and the second handle portion linking members 208 rotate about the axes $A_1$, $A_2$, $A_3$ and $A_4$. This causes the drive guide 226 and the actuation button 224 to rotate in a first direction about junction axes $J_1$ and $J_2$, relative to the locking structure 228. As the actuation button 224 rotates in the first direction, the at least one compressible radial flex member 252 and the locking teeth 262 lockingly interact to prevent the drive guide 226 and the actuation button 224 from rotating in a second direction, opposite the first direction. This effectively locks the container compression device 200 in the compressed configuration 222.

When the actuation button 224 is depressed, the at least one axial member 250 is compressed inward by the semi-annular protrusion 260 until the at least one axial member 250 deflects against the semi-annular protrusion 260 and is positioned below the semi-annular protrusion 260. This causes the at least one compressible radial flex member 252 to be positioned away from and thus disengaged from the locking teeth 262 allowing the drive guide 226 and locking structure 228 to rotate freely in any direction. This allows for the container compression device 200 to be configured back into the extended configuration 220 by pulling the first handle portion 202 and the second handle portion 204 away from each other. Accordingly, any container 202 positioned within the container compression device cavity 212 can be easily removed. When the first handle portion 202 and the second handle portion 204 are pulled away from each other the at least one axial member 250 rotates to a position relative to the locking structure 228, such that the at least one axial member 250 encounters a gap in, and/or is no longer in contact with, the semi-annular protrusion 260. This allows the actuation button 224 to move axially away from the end cap 230 in the direction of the force of the guide spring 257 such that the at least one compressible radial flex member 252 is again positioned adjacent the locking teeth 262. This allows the container compression device 200 to be springingly configurable between the compressed configuration 222 and the extended configuration 220.

Figure 11:
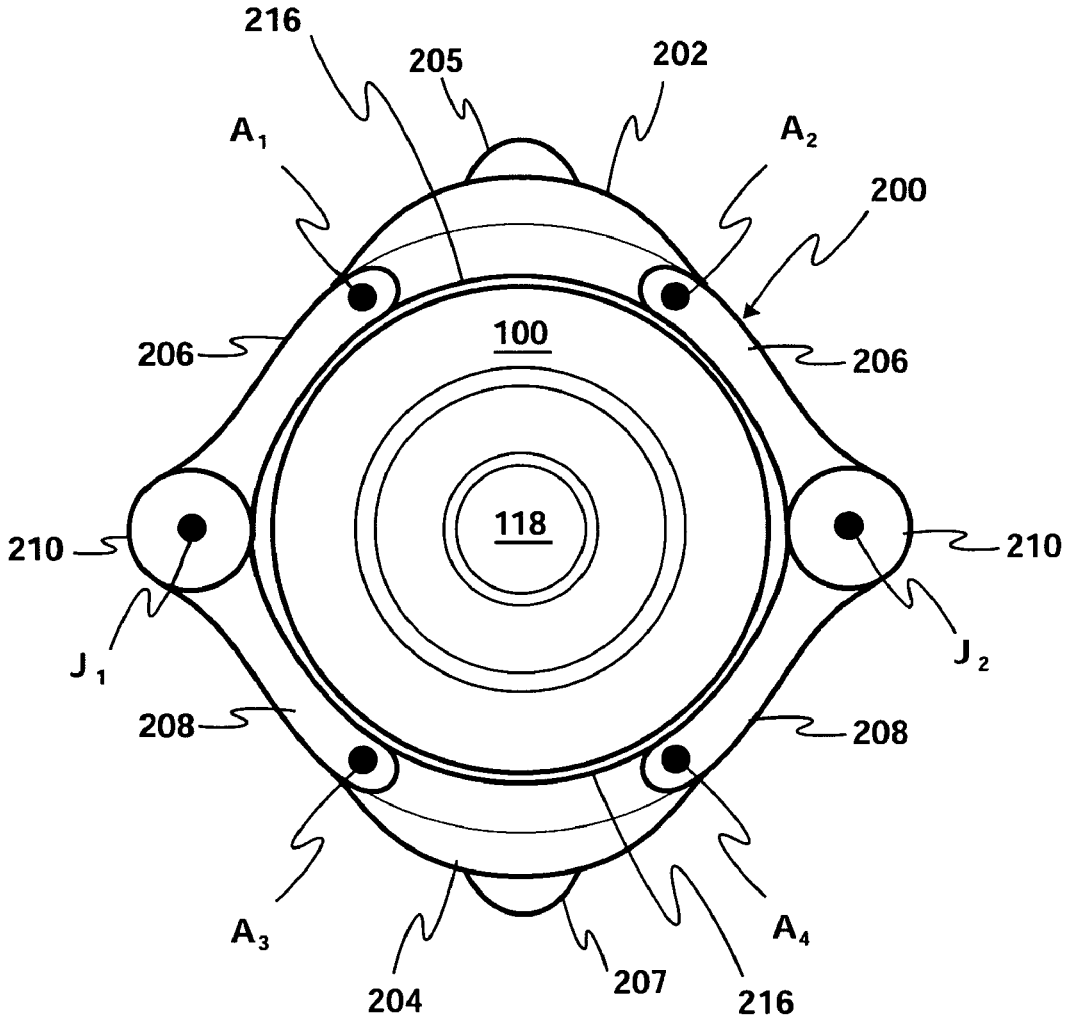
FIG. 11 is a top down view of the container compression device of FIG. 3 associated with the beverage container of FIG. 1, with the container compression device in its extended configuration.
Figure 12:
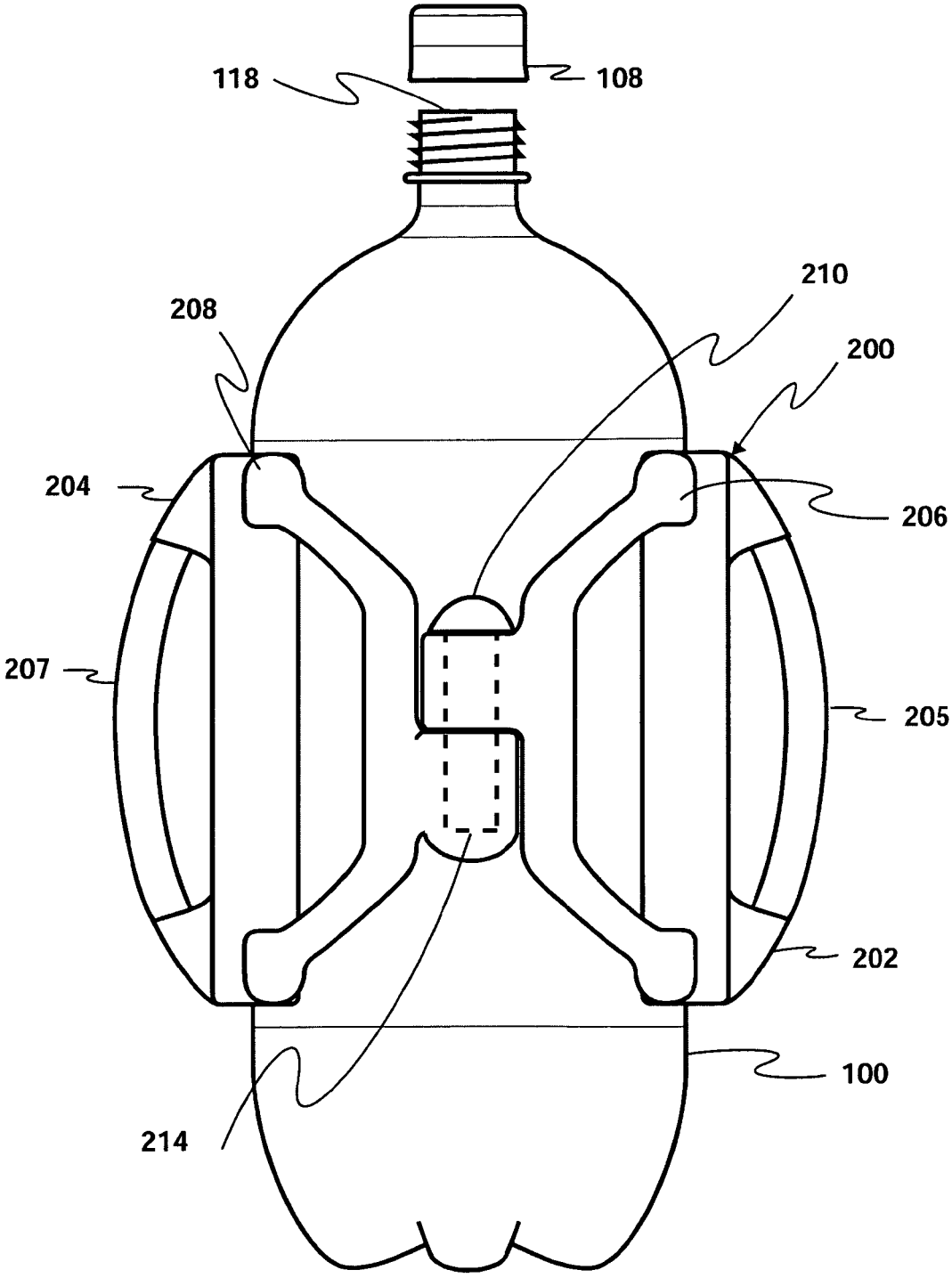
FIG. 12 is a front view of the container compression device of FIG. 3 associated with the beverage container of FIG. 1, with the container compression device in its extended configuration.
Figure 13:
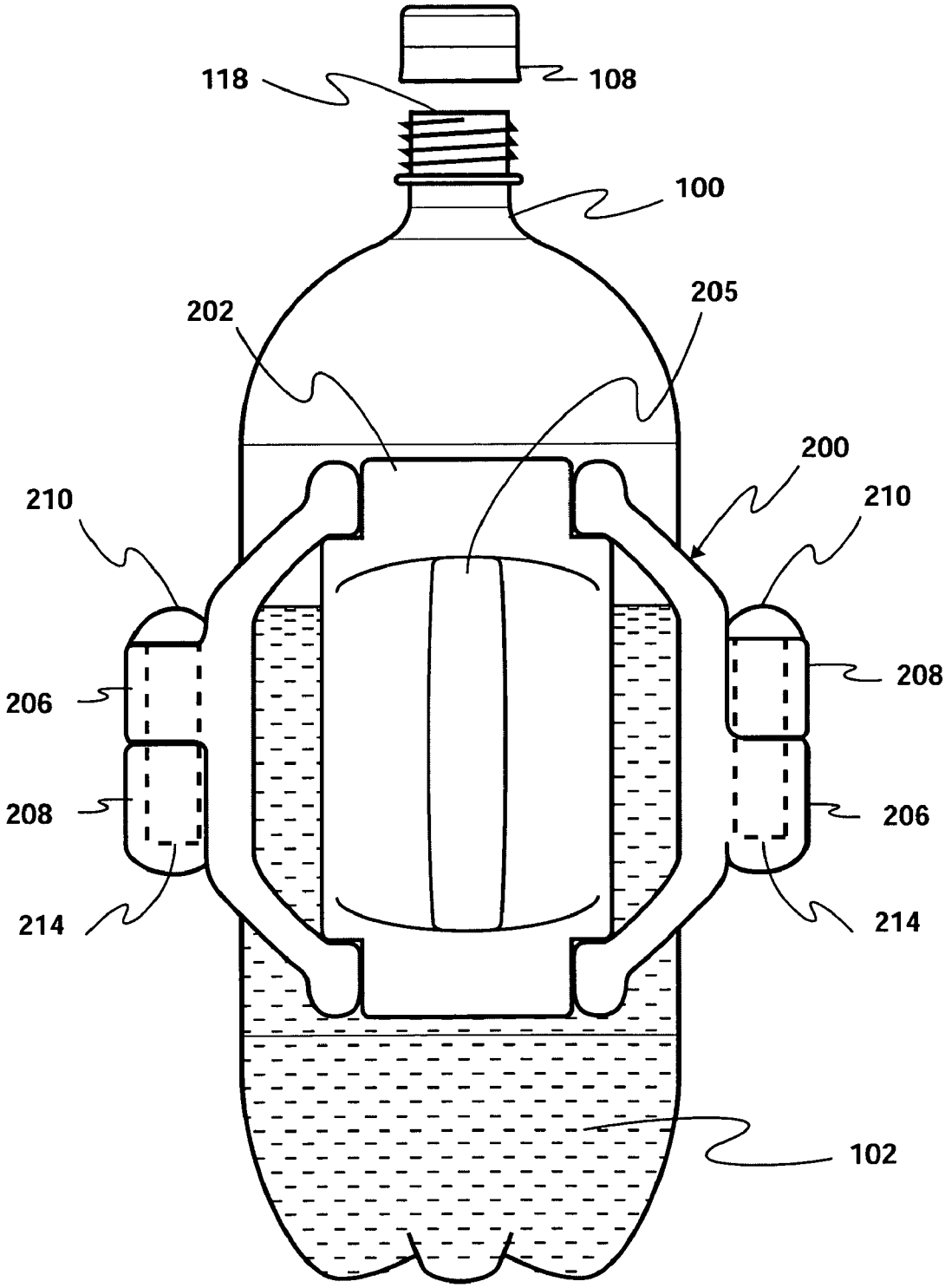
FIG. 13 is a side view of the container compression device of FIG. 3 associated with the beverage container of FIG. 1 containing a beverage, with the container compression device in its extended configuration.
Figure 14:
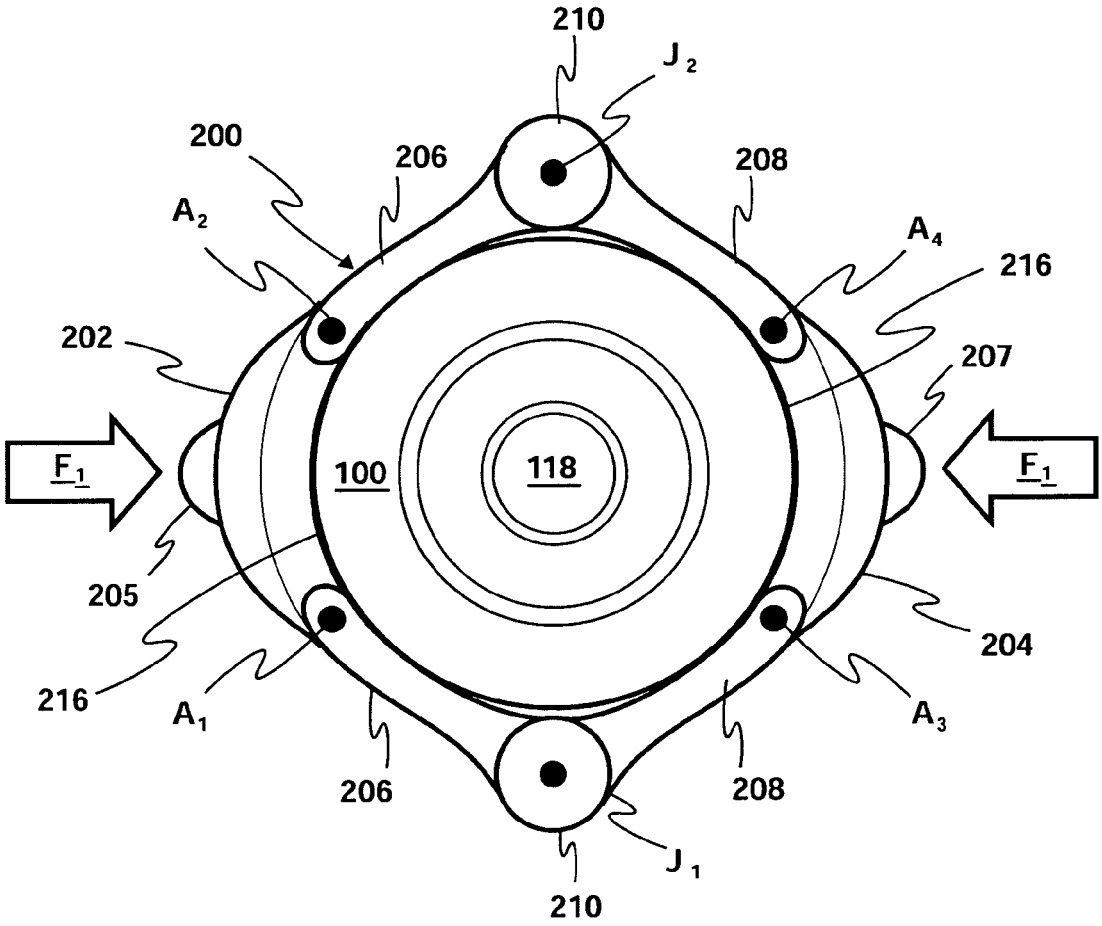
FIG. 14 is a top down view of the container compression device of FIG. 3 associated with the beverage container of FIG. 1.
Figure 15:
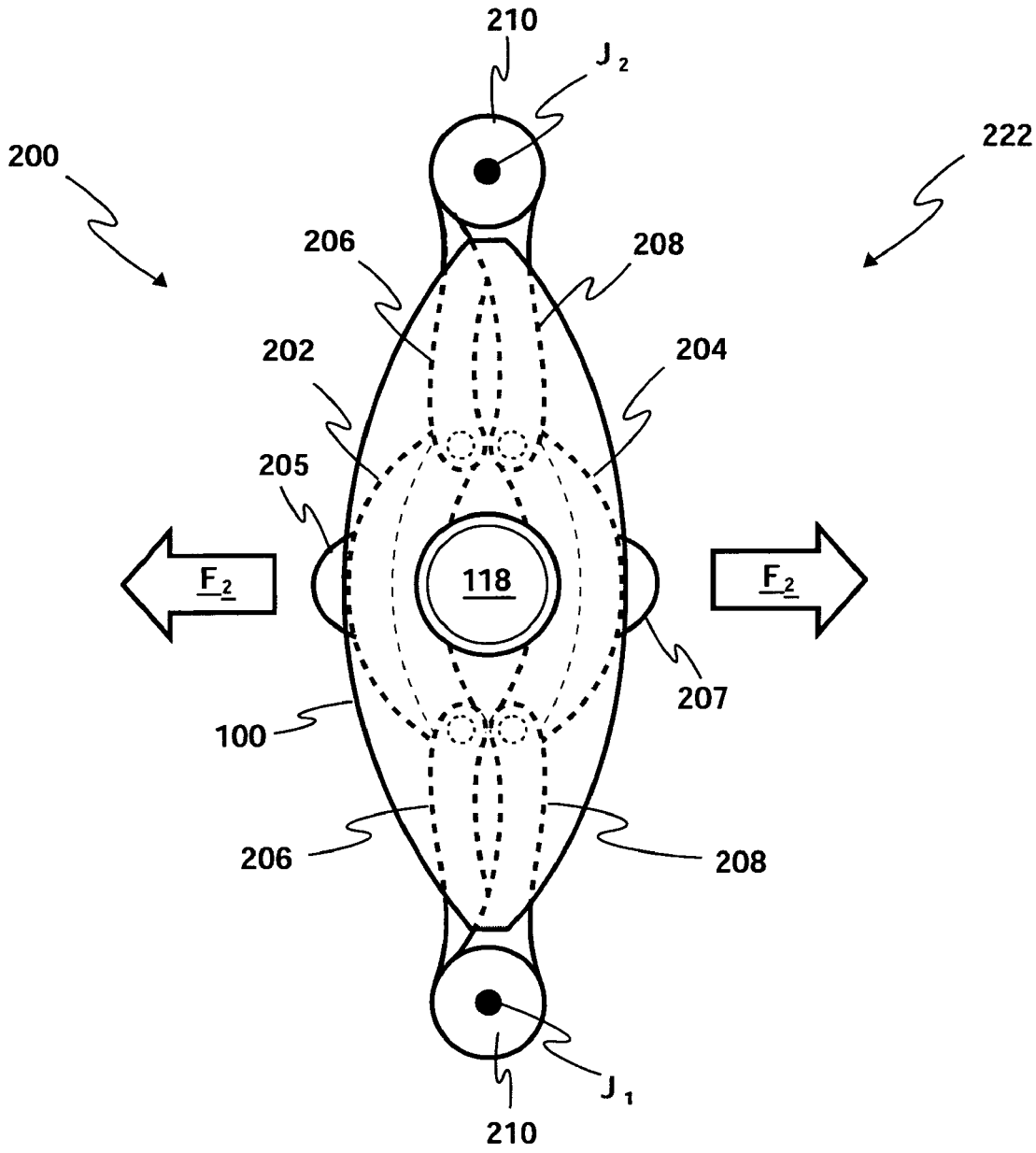
FIG. 15 is a top down view of the container compression device of FIG. 3 associated with the beverage container of FIG. 1, with the container compression device in its compressed configuration.
Figure 16:
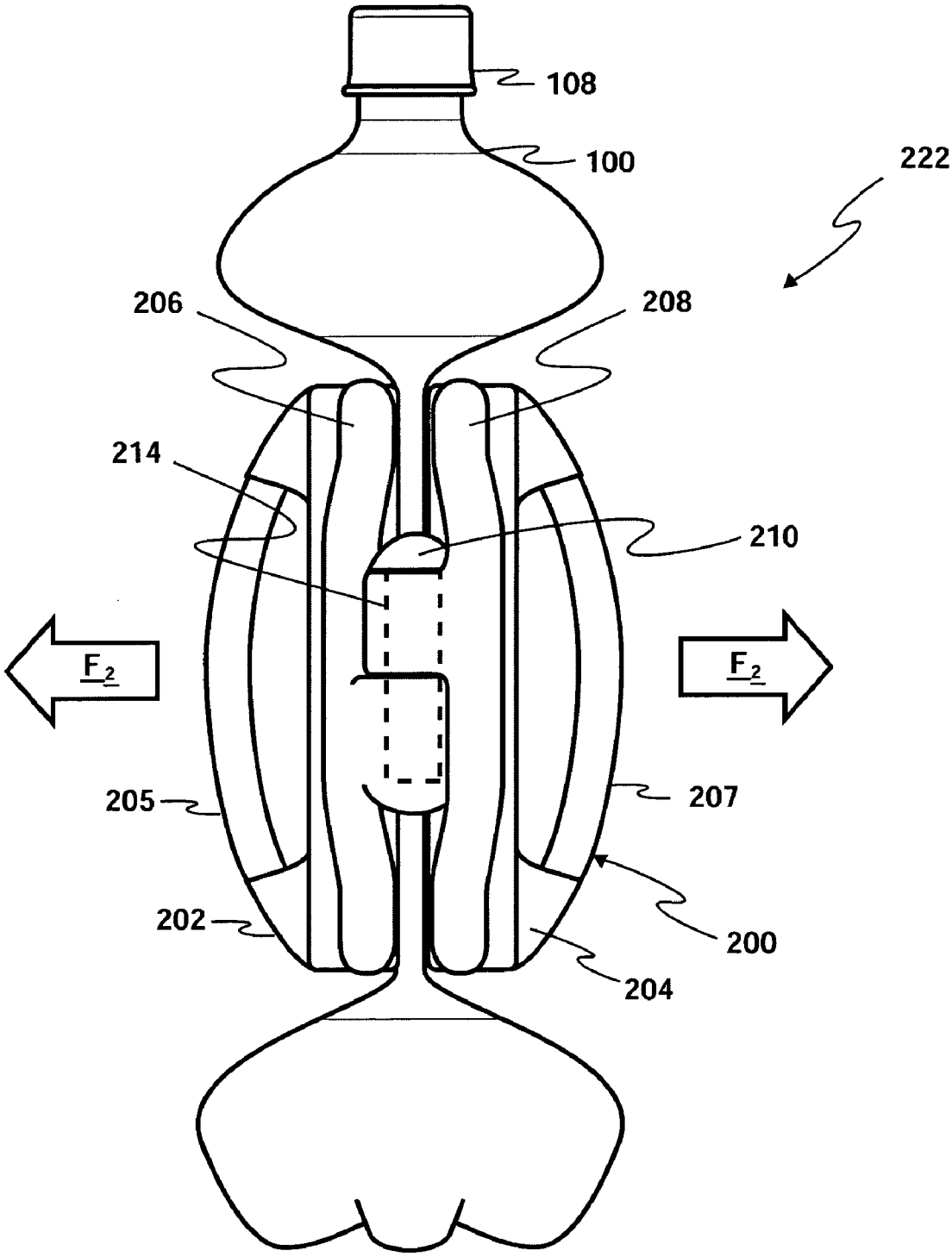
FIG. 16 is a front view of the container compression device of FIG. 3 associated with the beverage container of FIG. 1, with the container compression device in its compressed configuration.
Figure 17:
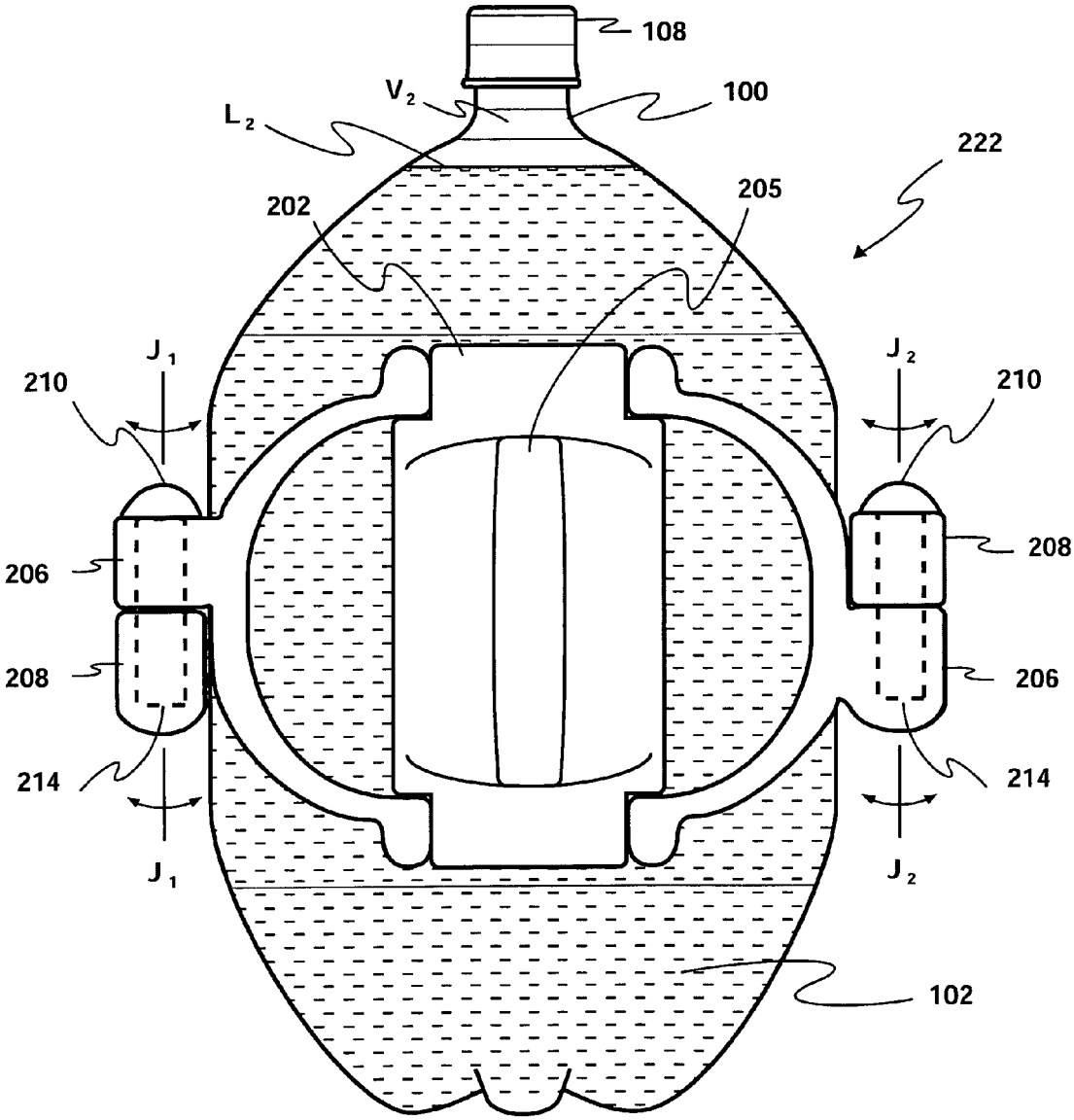
FIG. 17 is a side view of the container compression device of FIG. 3 associated with the beverage container of FIG. 1, with the container compression device in its compressed configuration.

In accordance with the present invention, the container compression device 200 operates as follows. As shown in FIG. 11, FIG. 12 and FIG. 13, a deformable beverage container 100 having a carbonated beverage contained therein is positioned within the container compression device cavity 212 such that the compression surfaces 216 of the first and second handle portions 202, 204 are located adjacent a middle portion of the deformable beverage container 100. With the cap 108 removed from the container, an inward force $F_1$ is applied to at least one of the first and second handle portions 202, 204 such that the compression surfaces 216 of the first and second handle portions 202, 204 make contact with a middle portion of the deformable beverage container 100, as shown in FIG. 14. The application of the inward force $F_1$ is continued causing the beverage container 100 to deform and the level $L_2$ of the beverage 102 contained within the container cavity 114 to increase until the level $L_2$ is just below the top of the container cavity 114. Accordingly, the volume $V_2$ of the space $L_2$ between the top of the container cavity 114 and the level $L_2$ of the beverage 102 is minimized. The cap 108 is then re-associated with the beverage container until the opening 118 is closed and an air tight seal is formed. As the inward force $F_1$ is applied to at least one of the first and second handle portions 202, 204, the releasable locking device 214 prevents the container compression device 200 from configuring back into the extended configuration 220.

Each time a portion of the beverage 102 within the beverage container 100 is removed, additional inward force $F_1$ can be applied to at least one of the first and second handle portions 202, 204 to keep the volume $V_2$ of the space $L_2$ minimized. When the container is empty, the actuation button 224 can be depressed to disassociate the at least one compressible radial flex member 252 from the locking teeth 262 as discussed hereinbefore. A force $F_2$ is then applied to at least one of the first and second handle portions 202, 204 to cause the container compression device 200 to be configured from the compressed configuration 222 back into the extended configuration 220 as discussed hereinbefore.

Figure 18:
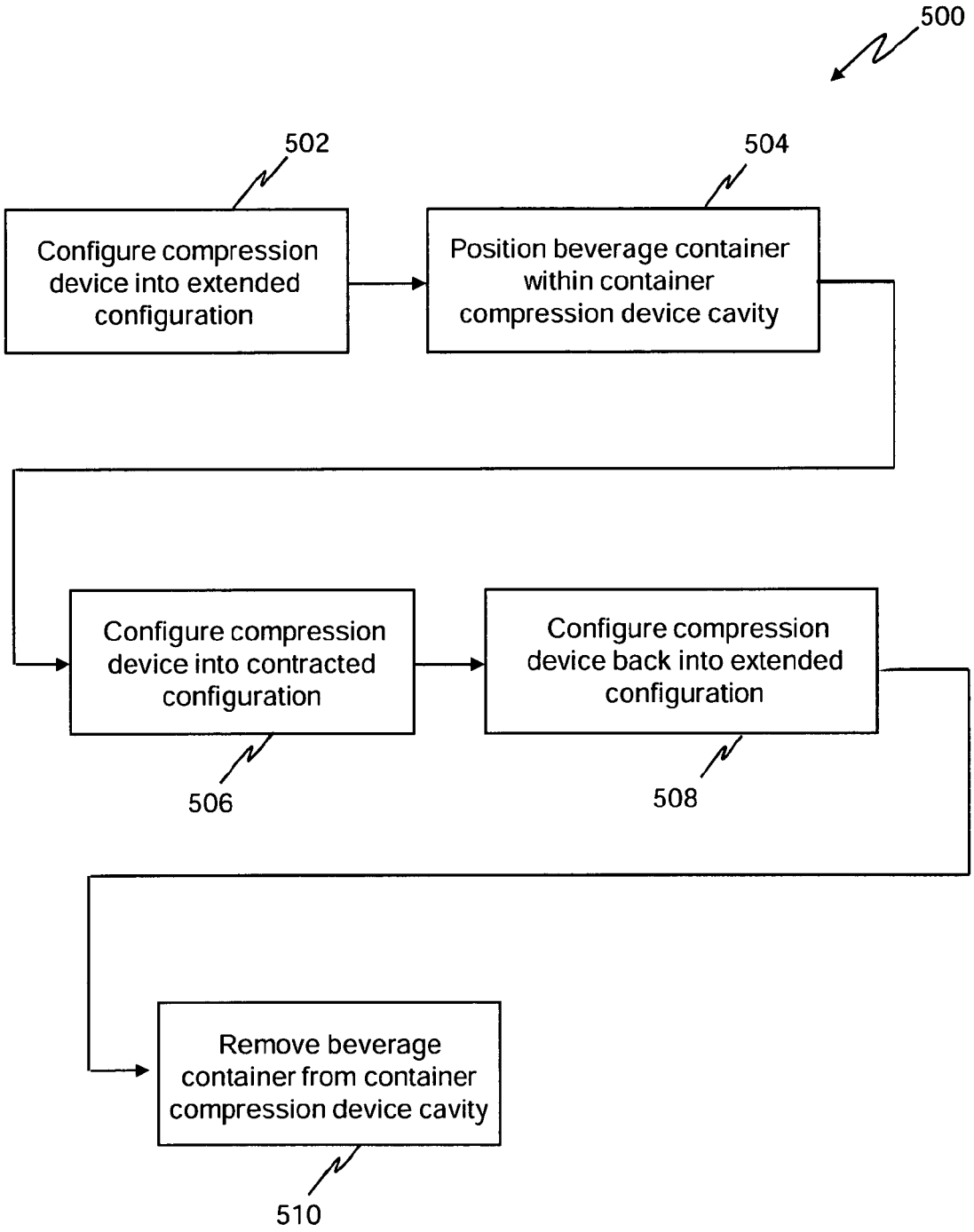
FIG. 18 is a block diagram illustrating a method for associating the container compression device of FIG. 3 with the beverage container of FIG. 1.

Referring to FIG. 18, a block diagram illustrating a method 500 for associating a beverage container 100 with the container compression device 200 is shown and includes configuring the container compression device 200 into the extended configuration 220, as shown in operational block 502. The cap 108 of the beverage container 100 is removed and the beverage container 100 is positioned within the container compression device cavity 212, as shown in operational block 504. The container compression device 200 is configured into the compressed configuration 222, as discussed hereinbefore and as shown in operational block 506. As additional amounts of the beverage 102 is removed from the beverage container 100 operational block 506 may be repeated as desired. The container compression device 200 is configured into the extended configuration 220, as discussed hereinbefore and as shown in operational block 508, and the beverage container is removed from the container compression device cavity 212 as shown in operational block 510.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A manual container compression device defining a container compression device cavity for holding a beverage container, wherein the container compression device is configurable between an extended configuration and a compressed configuration for manually compressing the beverage container, the container compression device comprising:

a first compression surface;

a plurality of first linking members pivotably connected to said first compression surface;

a second compression surface;

a plurality of second linking members pivotably connected to said second compression surface;

a first handle junction; and a second handle junction, said first handle junction being located opposite to said second handle junction, wherein said first handle junction is formed by pivotally connecting one of said plurality of first linking members with one of said plurality of second linking members and said second handle junction is formed by pivotally connecting the other of said plurality of first linking members with the other of said plurality of second linking members, and wherein at least one of said plurality of first linking members is pivotably connected with at least one of said plurality of second linking members via a releasable locking device, said releasable locking device being configurable between an engaged configuration and a disengaged configuration to lockingly configure the container compression device between the extended configuration and the compressed configuration, wherein when the container compression device is configured in the extended configuration the container compression device cavity is larger than when the container compression device is configured in the compressed configuration.

2. The container compression device of claim 1, wherein said plurality of first linking members includes two first linking members.

3. The container compression device of claim 1, wherein said plurality of second linking members includes two second linking members.

4. The container compression device of claim 1, wherein said first compression surface and said second compression surface are located adjacent the container compression device cavity and are substantially curved in shape.

5. The container compression device of claim 4, wherein said first compression surface and said second compression surface are configured to securely interact with the beverage container when the container compression device is configured in the compressed configuration.

6. The container compression device of claim 4, wherein said compression surface is at least one of a ring shape having a hollow portion, a substantially flat shape or a slightly curved shape.

7. The container compression device of claim 1, wherein said releasable locking device includes a compressible radial flex member and a plurality of structure teeth.

8. The container compression device of claim 7, wherein when said releasable locking device is in said engaged configuration said compressible radial flex member is disposed adjacent said plurality of structure teeth such that said compressible radial flex member and said plurality of structure teeth lockingly interact and when said releasable locking device is in said disengaged configuration said compressible radial flex member is disposed away from said plurality of structure teeth.

9. The container compression device of claim 1, wherein said releasable locking device includes a depressible actuation button, said releasable locking device being configurable between said engaged configuration and said disengaged configuration via said depressible actuation button.

10. A manual container compression device defining a container compression device cavity for holding a beverage container, wherein the container compression device is configurable between an extended configuration and a compressed configuration for manually compressing the beverage container, the container compression device comprising:

a plurality of compression surfaces;

a plurality of first linking members; and a plurality of second linking members, said plurality of first linking members and said plurality of second linking members being pivotably associated with each other to form at least one handle junction having a releasable locking device, said releasable locking device being configurable between an engaged configuration and a disengaged configuration to lockingly configure the container compression device between the extended configuration and the compressed configuration, wherein when the container compression device is configured in the extended configuration the container compression device cavity is larger than when the container compression device is configured in the compressed configuration.

11. The container compression device of claim 10, wherein said plurality of compression surfaces includes a first compression surface and a second compression surface.

12. The container compression device of claim 10, wherein said at least one handle junction includes a first handle junction and a second handle junction, wherein one of said plurality of first linking members is pivotably connected to one of said plurality of second linking members to form said first handle junction and wherein the other of said plurality of first linking members is pivotably connected to other of said plurality of second linking members to form said second handle junction.

13. The container compression device of claim 12, further including a second releasable locking device, wherein said first handle junction includes said releasable locking device and said second handle junction includes said second releasable locking device.

14. The container compression device of claim 10, wherein said releasable locking device includes a compressible radial flex member and a plurality of structure teeth.

15. The container compression device of claim 14, wherein when said releasable locking device is in said engaged configuration said compressible radial flex member is disposed adjacent said plurality of structure teeth such that said compressible radial flex member and said plurality of structure teeth lockingly interact and when said releasable locking device is in said disengaged configuration said compressible radial flex member is disposed away from said plurality of structure teeth.

16. The container compression device of claim 15, wherein said releasable locking device includes a depressible actuation button, said releasable locking device being configurable between said engaged configuration and said disengaged configuration via said depressible actuation button.

17. The container compression device of claim 10, wherein said plurality of compression surfaces are located adjacent the container compression device cavity and are substantially curved in shape.

18. The container compression device of claim 17, wherein at least one of said compression surfaces is configured to securely interact with the beverage container when the container compression device is configured in the compressed configuration.

19. The container compression device of claim 17, wherein at least one of said compression surfaces is at least one of a ring shape having a hollow portion, a substantially flat shape or a slightly curved shape.

20. The container compression device of claim 1, further comprising a handle portion having a gripping member.

* * * * *